US009758924B2

(12) United States Patent
Struminger

(10) Patent No.: US 9,758,924 B2
(45) Date of Patent: Sep. 12, 2017

(54) GARMENT HOLDING DEVICE

(71) Applicant: Ronald Struminger, New Brunswick, NJ (US)

(72) Inventor: Ronald Struminger, New Brunswick, NJ (US)

( * ) Notice: Subject to any disclaimer, the term of this patent is extended or adjusted under 35 U.S.C. 154(b) by 0 days.

(21) Appl. No.: 14/844,179

(22) Filed: Sep. 3, 2015

(65) Prior Publication Data

US 2016/0157568 A1 Jun. 9, 2016

Related U.S. Application Data

(60) Provisional application No. 62/087,353, filed on Dec. 4, 2014.

(51) Int. Cl.
*A44B 99/00* (2010.01)
*D06F 95/00* (2006.01)

(52) U.S. Cl.
CPC ..... *D06F 95/008* (2013.01); *Y10S 24/29* (2013.01); *Y10T 24/1397* (2015.01)

(58) Field of Classification Search
CPC .... D06F 95/008; Y10T 24/1397; Y10T 24/29; Y10T 24/4447
See application file for complete search history.

(56) References Cited

U.S. PATENT DOCUMENTS 3,321,736 A * 5/1967 Flynn ..... H01R 11/24 294/99.2
3,458,188 A * 7/1969 Infante ..... G09B 19/0015 182/4
5,067,618 A 11/1991 Johnson
5,357,660 A 10/1994 Smith
5,671,876 A 9/1997 Gardner
6,389,657 B1 5/2002 Turner
6,434,800 B1 * 8/2002 James ..... A63B 60/62 24/298
7,040,517 B1 * 5/2006 Swanson ..... A47G 25/10 223/85
7,631,753 B1 12/2009 Temmel

* cited by examiner

*Primary Examiner* — Robert J Sandy
(74) *Attorney, Agent, or Firm* — Global Intellectual Property Agency, LLC; Daniel Boudwin

(57) ABSTRACT

A garment holding device for washing or drying garments in an organized manner so as to prevent pairs of garment from becoming separated. The garment holding device includes an elongated cable disposed in a loop configuration, wherein the cable includes a first end removably secured to a second end. A plurality of clips are removably secured to the cable, wherein each clip can hold a pair of socks, gloves, or other paired garments for the purpose of keeping the garments together while being washed or dried. Each clip includes an aperture that is able to receive the elongated cable therethrough and a plurality of teeth that prevent the paired garments from becoming removed therefrom while in the washer or dryer. A clip, along with a clean pair of garments thereon, can be removed from the elongated cable in order to store the pair of garments together in a drawer.

3 Claims, 2 Drawing Sheets

GARMENT HOLDING DEVICE

CROSS REFERENCE TO RELATED APPLICATION

This application claims the benefit of U.S. Provisional Application No. 62/087,353 filed on Dec. 3, 2014. The above identified patent application is herein incorporated by reference in its entirety to provide continuity of disclosure.

BACKGROUND OF THE INVENTION

Field of the Invention

The present invention relates to garment holding devices. More specifically, the present invention provides a garment holding device comprising an elongated cable disposed in a loop configuration, wherein a plurality of clips are disposed thereon. Each clip is adapted to hold a pair of socks, gloves, or other paired garments for the purpose of keeping the garments together while being washed or dried.

Many people do not take the time to match socks, gloves, or other paired garments when preparing to wash or putting away laundry due to the difficulty and amount of time required to sort through a pile of various garments. Socks can become stuck to or inside of various other garments, such as shirts and pants, adding to the difficulty of matching the same. Furthermore, putting away unmatched socks in a drawer makes it difficult to find a pair of matching socks the next time an individual reaches into the drawer. Therefore, there exists a need in the prior art for a device that helps to keep socks and other paired items together while being washed or dried.

Devices have been disclosed in the prior art that relate to garment holding devices. These include devices that have been patented and published in patent application publications. These devices generally relate to a pair of arms that can removably secure to one another and hold a pair of socks therebetween, such as U.S. Pat. Nos. 5,671,876 and 6,389,657. Another device, U.S. Pat. No. 7,631,753 generally relates to an organizer comprising a rod having protrusions extending from opposing sides, such that a pair of socks can hang from the opposing protrusions in order to remain organized. Another device, U.S. Pat. No. 5,067,618, generally relates to a device resembling a duck having fasteners disposed through the duck and adapted to receive socks thereon. One other device, U.S. Pat. No. 5,357,660, relates to a container having clips disposed in a stacked configuration therein.

These prior art devices have several known drawbacks. The devices in the prior art fail to disclose an elongated cable disposed in a loop configuration having a plurality of clips disposed thereon. The devices are capable of holding socks thereon, however, the devices do not allow for clips to move along the support device for the convenient removal or addition of clips to the sock cable, which allows for the socks to remain in an organized manner even when removed from the cable. Thus, the prior art devices fail to disclose a garment holding device that can be used to wash and dry garments in an organized manner, as well as allowing the garments to remain in an organized manner once removed from the cable.

In light of the devices disclosed in the prior art, it is submitted that the present invention substantially diverges in design elements from the prior art and consequently it is clear that there is a need in the art for an improvement to existing garment holding devices. In this regard the instant invention substantially fulfills these needs.

SUMMARY OF THE INVENTION

In view of the foregoing disadvantages inherent in the known types of garment holding devices now present in the prior art, the present invention provides a new garment holding device wherein the same can be utilized for providing convenience for the user when washing and drying in an organized manner.

It is therefore an object of the present invention to provide a new and improved garment holding device that has all of the advantages of the prior art and none of the disadvantages.

It is another object of the present invention to provide a garment holding device comprising an elongated cable disposed in a loop configuration having a first end removably secured to a second end.

Another object of the present invention is to provide a garment holding device further comprising a plurality of clips disposed on the elongated cable and adapted to hold garments thereon.

Yet another object of the present invention is to provide a garment holding device wherein the plurality of clips each comprise an aperture thereon, wherein the aperture is adapted to receive the elongated cable therethrough.

Yet another object of the present invention is to provide a garment holding device wherein the plurality of clips each comprise a plurality of teeth adapted to prevent the socks, gloves, or other paired garments from becoming removed from the clips while in the washer or dryer.

Another object of the present invention is to provide a garment holding device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
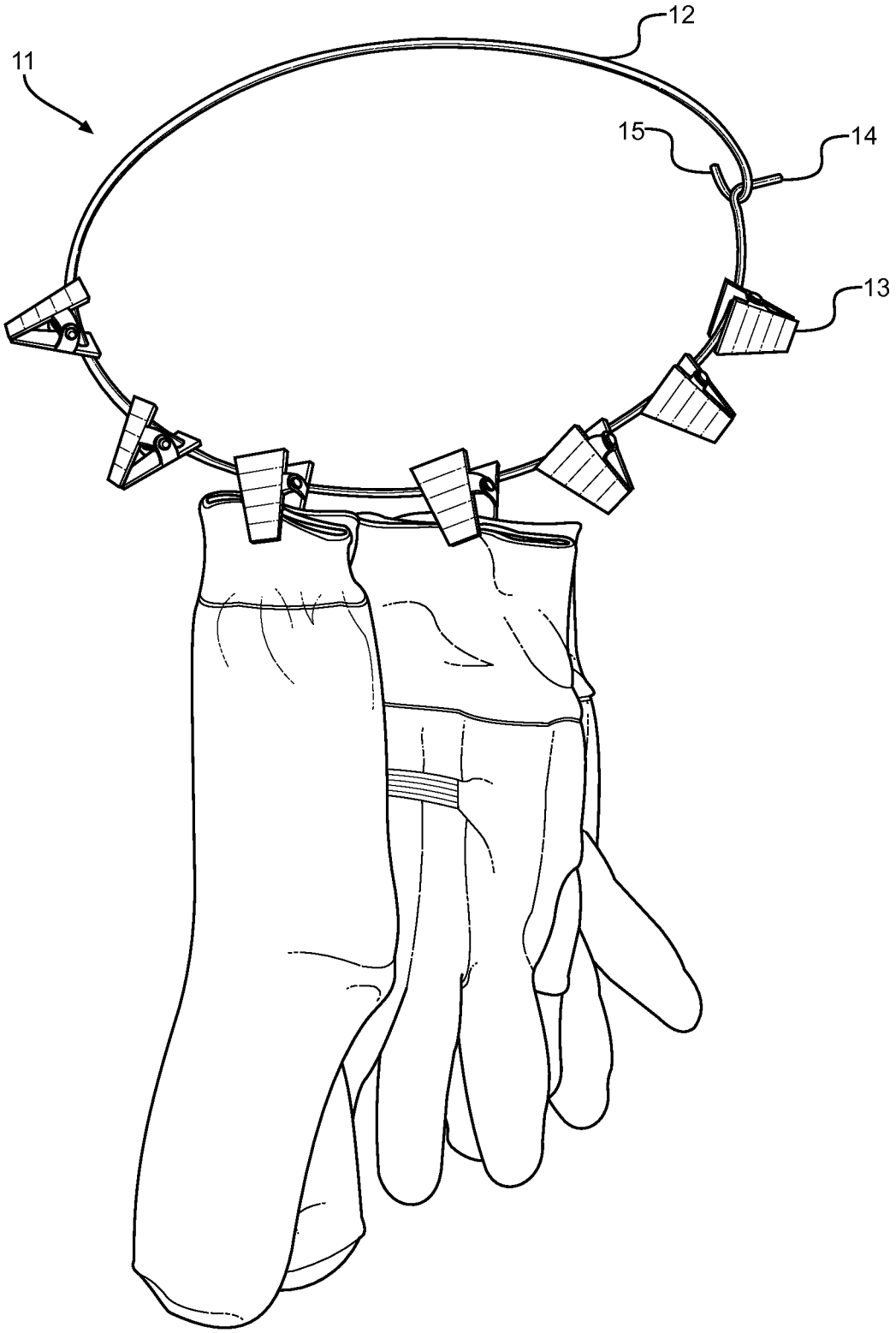
FIG. 1 shows a perspective view of the garment holding device wherein clips are holding garments thereon.

Reference is made herein to the attached drawings. Like reference numerals are used throughout the drawings to depict like or similar elements of the garment holding device. For the purposes of presenting a brief and clear description of the present invention, the preferred embodiment will be discussed as used for washing and drying pairs of garments, such as socks and gloves. The figures are intended for representative purposes only and should not be considered to be limiting in any respect.

Referring now to FIG. 1, there is shown a perspective view of the garment holding device wherein clips are holding garments thereon. The garment holding device 11 is adapted to keep pairs of garments together while being washed or dried, such as socks or gloves. The garment holding device 11 comprises an elongated cable 12 and a plurality of clips 13 disposed thereon. The elongated cable 12 is flexible and disposed in a loop configuration, wherein the cable 12 includes a first end 14 removably secured to a second end 15. In the illustrated embodiment, the first end 14 comprises an L-shaped configuration and the second end 15 comprises a hook shaped fastener. The first end 14 is adapted to be positioned through the hook shaped fastener on the second end 15. Thus, the first and second ends 14, 15 are removably securable to one another in order to allow the clips 13 to be removed from the elongated cable 12. In alternate embodiments, the garment holding device 11 can comprise any suitable fastener that allows the first end 14 to removably secure to the second end 15, such as a tie, hook and loop material, a snap, or a clasp disposed on the first end 14 and ring disposed on the second end 15. The cable 12 can be composed of any suitable material, including a durable and flexible metal or plastic material that will not corrode or weaken when exposed to warm water and detergent. In some embodiments, the elongated cable 12 comprises a strap, rope, wire, or the like, so as to allow the elongated cable to form a loop configuration. In other embodiments, the elongated cable 12 can be disposed in other configurations, such as U-shaped, straight, and the like, as long as the first end 14 and second end 15 provide an obstacle, such as a stopper, to prevent the clips 13 from becoming removed therefrom.

Each clip 13 is adapted to hold a pair of socks, gloves, or other paired garments thereon. In the illustrated embodiment, alligator clips are used to hold the garments therebetween. However, in other embodiments, any type of suitable clip 13 may be used. The clips 13 are preferably spaced around the elongated cable 12 to separate the pairs of socks from one another. In some embodiments, additional clips 13 can be removably secured to the elongated cable 12 in order to accommodate additional garments.

Figure 2A:
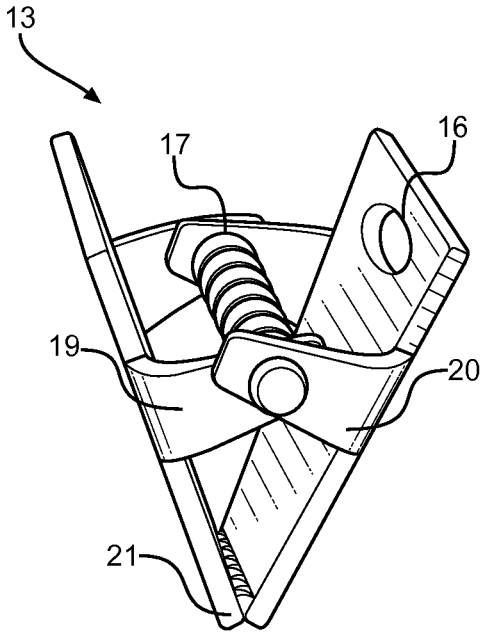
FIG. 2A shows a close-up view of a clip of the garment holding device wherein the clip is in a closed configuration.
Figure 2B:
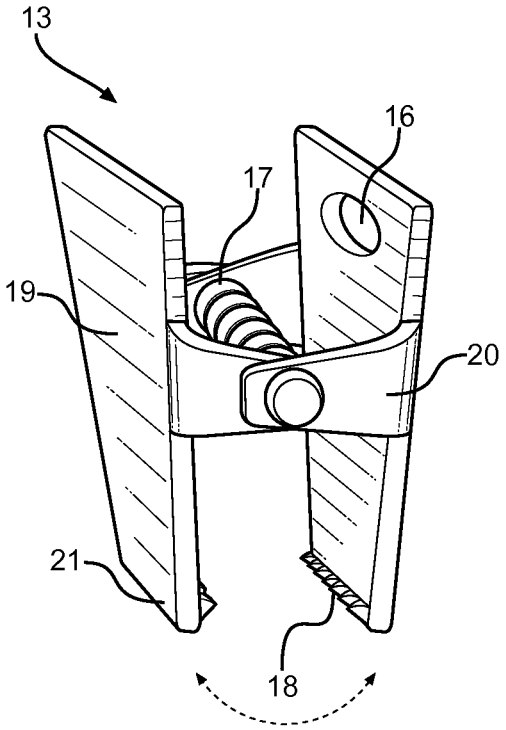
FIG. 2B shows a close-up view of the clip of the garment holding device wherein the clip is in an open configuration.

Referring now to FIGS. 2A and 2B, there is shown a close-up view of a clip of the garment holding device wherein the clip is in a closed configuration and a close-up view of the clip of the garment holding device wherein the clip is in an open configuration. Each clip 13 comprises a first side 19 pivotally connected to a second side 20, wherein the clip 13 is movable between an open configuration and a closed configuration. In a closed orientation, the lower end 21 of each side 19, 20 of the clip 13 is pressed against one another or pressed against a garment if a garment is disposed therebetween. In an open configuration, the lower end 21 of the sides 19, 20 are separated in order to receive a garment therebetween. The sides 19, 20 of the clip are secured to one another by a spring biased hinge 17. The hinge 17 allows the clip 13 to remain in a closed orientation unless a user applies force to the upper ends of both sides 19, 20 thereof.

Each clip 13 further comprises an aperture 16 disposed on the upper end of at least one side 19, 20. The aperture 16 is adapted to receive the elongated cable therethrough and allows the clip 13 to move along the cable. In operation, a user can thread the elongated support through the apertures 16 of one or more clips 13 so that the clips 13 are removably secured to the elongated support along the length thereof. The user can then secure the first and second ends of the elongated support to form a loop, wherein the clips 13 are prevented from escaping or being removed from the elongated support. The aperture 16 further permits the clip 13 to be removed from the elongated cable. Thus, if a user desires to maintain the organization of his or her socks after the laundry has been completed, the clip 13 can be removed from the elongated cable and stored in a drawer until needed. The clips 13 are preferably composed of a durable material that can withstand warm water and laundry detergent.

The lower end 21 of each side 19, 20 of the clip 13 comprises securement mechanism in order to allow the garments to remain securely thereon. In the illustrated embodiment, the secure mechanism comprises a plurality of teeth 18 adapted to allow the garments to maintain their position within the clip 13 during the turbulence experienced during wash cycle or dryer cycle. In alternate embodiments, lower end 21 of the clip 13 comprises any suitable securement mechanism, such as a high friction pad disposed on both sides 19, 20 of the clip 13. In operation, a user places a pair of garments between the teeth 18 of the clip 13 and places the garment holding device in the washer or dryer. Once the washing or drying process is complete, the user may remove the socks from the clip 13 or remove the clip 13 from the elongated cable by unhooking the first end of the elongated cable from the second end thereof.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment holding device, comprising:

an elongated cable disposed in a loop configuration, wherein said elongated cable comprises a first end removably secured to a second end;

a plurality of clips disposed on said elongated cable and adapted to hold one or more garments thereon;

wherein each of said plurality of clips comprise an aperture disposed on a side thereof, such that said elongated cable is disposed through said aperture;

wherein said first end comprises an L-shaped configuration and said second end comprises a hook thereon, such that said first end is adapted to be positioned through said hook disposed on said second end of said elongated cable.

2. The garment holding device of claim 1, wherein each of said plurality of clips comprise a first side pivotally secured to a second side, wherein a lower end of said first side and said second side each comprise a plurality of teeth adapted to removably secure said one or more garments therebetween.

3. The garment holding device of claim 1, wherein said plurality of clips are alligator clips.

* * * * *